US007697257B2

(12) United States Patent
Tepper et al.

(10) Patent No.: US 7,697,257 B2
(45) Date of Patent: Apr. 13, 2010

(54) METHODS, SYSTEMS AND APPARATUSES FOR CHEMICAL COMPOUND GENERATION, DISPERSION AND DELIVERY UTILIZING DESORPTION ELECTROSPRAY IONIZATION

(75) Inventors: Gary C. Tepper, Glen Allen, VA (US); Royal Kessick, Richmond, VA (US); Dmitry Pestov, Glen Alen, VA (US)

(73) Assignee: Sentor Technologies, Inc., Glen Allen, VA (US)

( * ) Notice: Subject to any disclaimer, the term of this patent is extended or adjusted under 35 U.S.C. 154(b) by 152 days.

(21) Appl. No.: 11/780,462

(22) Filed: Jul. 19, 2007

(65) Prior Publication Data

US 2008/0029695 A1 Feb. 7, 2008

Related U.S. Application Data

(60) Provisional application No. 60/807,820, filed on Jul. 19, 2006.

(51) Int. Cl.
*H01J 49/10* (2006.01)

(52) U.S. Cl. ..... 361/227; 361/228; 361/229; 604/19; 604/21; 604/22; 604/23; 604/24; 604/25; 604/26; 128/200.14; 128/200.24; 128/202.25; 128/202.26

(58) Field of Classification Search ..... 250/282, 250/288, 281, 283, 285; 361/227, 228, 229; 604/19, 20, 21, 23, 24, 25, 26; 128/200.14, 128/200.24

See application file for complete search history.

(56) References Cited

U.S. PATENT DOCUMENTS

| | | | | |
|---|---|---|---|---|
| 6,297,499 | B1 * | 10/2001 | Fenn | 250/288 |
| 2003/0111600 | A1 * | 6/2003 | Thomson et al. | 250/288 |
| 2003/0201390 | A1 * | 10/2003 | Corso et al. | 250/288 |
| 2004/0023411 | A1 * | 2/2004 | Fenn | 436/174 |
| 2004/0072337 | A1 * | 4/2004 | Moon et al. | 435/287.2 |
| 2005/0056776 | A1 * | 3/2005 | Willoughby et al. | 250/281 |
| 2005/0230635 | A1 * | 10/2005 | Takats et al. | 250/424 |
| 2006/0068090 | A1 * | 3/2006 | Monbouquette et al. | 427/180 |
| 2006/0185511 | A1 * | 8/2006 | Tepper | 95/71 |
| 2007/0148670 | A1 * | 6/2007 | O'Malley | 435/6 |
| 2007/0187589 | A1 * | 8/2007 | Cooks et al. | 250/288 |
| 2007/0251871 | A1 * | 11/2007 | Tubbs et al. | 210/198.2 |

* cited by examiner

*Primary Examiner*—Jack I Berman
*Assistant Examiner*—Nicole Ippolito Rausch
(74) *Attorney, Agent, or Firm*—Michael P. Eddy

(57) ABSTRACT

Apparatuses, systems and methods for generating, dispersing and delivering chemical compounds utilizing desorption electrospray ionization. Embodiments include an airflow channel into which an airflow is directed, a solvent reservoir containing a volume of solvent, at least one charged droplet source for producing a plurality of charged liquid droplets in the channel, and at least one grounded counter electrode positioned within the channel with the electrodes having at least one surface containing one or more chemical compounds that include releasable ions. In operation, the charged droplets are directed onto the surface or surfaces so that the impact of the charged particles on said surface produces gaseous ions of at least one chemical compound on said surface, after which the gaseous ions are dispersed into the airflow.

25 Claims, 3 Drawing Sheets

METHODS, SYSTEMS AND APPARATUSES FOR CHEMICAL COMPOUND GENERATION, DISPERSION AND DELIVERY UTILIZING DESORPTION ELECTROSPRAY IONIZATION

CROSS-REFERENCES TO RELATED PATENT APPLICATIONS

This application claims the benefit of U.S. provisional application Ser. No. 60/807,820, filed Jul. 19, 2006 which is incorporated herein by reference in its entirety for all purposes.

STATEMENT REGARDING FEDERALLY SPONSORED RESEARCH OR DEVELOPMENT

Not Applicable.

REFERENCE TO SEQUENCE LISTING, A TABLE, OR A COMPUTER PROGRAM LISTING COMPACT DISK APPENDIX

Not Applicable.

BACKGROUND

Field of the Invention

Embodiments of the claimed subject matter relate to methods, systems and apparatuses for generating, dispersing and delivering chemical compounds, and more particularly, to systems, methods and apparatuses utilizing desorption electrospray ionization to generate, disperse, and/or deliver one or more chemical compounds including biomedical compounds and fragrance compounds into an air stream or any other suitable medium capable of receiving the one or more chemical compounds.

Researchers at Purdue University have described methods for releasing gaseous ions from a material present on a surface. One publication by Graham Cooks may be found in Science, Vol. 306, pages 471-473, published in October of 2004. The described method, referred to as the Desorption Electrospray Ionization or DESI method, first directing electrosprayed charged droplets and ions of solvent onto a surface. The impact of the charged particles on the surface produced gaseous ions of the material present on the surface. Next, the method included performing mass spectrometry on the ions released from the surface so that they could be further analyzed.

SUMMARY

The claimed subject matter relates to improved apparatuses, systems and methods for generating, dispersing and delivering chemical compounds utilizing desorption electrospray ionization which include an airflow channel with an inlet and an outlet into which an airflow is directed, a solvent reservoir containing a volume of solvent, at least one charged droplet source for producing a plurality of charged liquid droplets in the airflow channel, at least one grounded counter electrodes positioned within the airflow channel with the electrodes having at least one surface containing one or more chemical compounds that include releasable ions. The voltage between the one or more grounded counter electrodes and the one or more charged droplet sources is sufficient to maintain an electric field which is sufficient to sustain an electrospray process in the airflow channel. In operation, the charged droplets are directed onto the surface or surfaces so that the impact of the charged particles on said surface produces gaseous ions of at least one chemical compound on said surface, after which the gaseous ions are dispersed into the airflow and directed out of the electric field region.

BRIEF DESCRIPTION OF THE DRAWINGS

The accompanying drawings, which are incorporated in and constitute a part of this specification, illustrate embodiments of the claimed subject matter, and, together with the description, further explain the claimed subject matter. In the drawings.

DETAILED DESCRIPTION OF THE EMBODIMENTS

Figure 1:
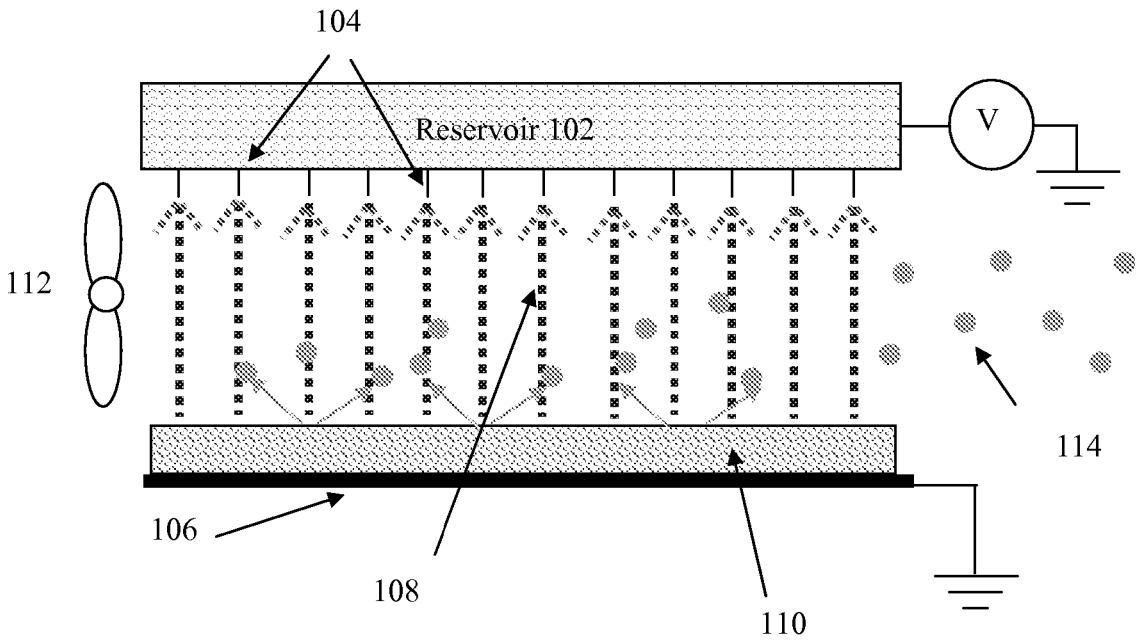
FIG. 1 is a schematic diagram of aspects of an embodiment according to the inventive subject matter.

In describing the disclosed subject matter, including those embodiments illustrated in the drawings, specific terminology is employed for the sake of clarity. Although these parameters will now be discussed in further detail, these descriptions are not an exhaustive explanation of all possible variations in structure and operation. It will be apparent to those skilled in the art that various other changes or modifications can be made without departing from the spirit and scope of the embodiments presented herein. It should be further apparent that any or all combinations of the individual described variations with the disclosed embodiments are possible.

Embodiments of the present subject matter include the use of the previously referenced DESI process in methods, systems and apparatuses. Instead of using the released molecules for analytical purposes, these embodiments used the molecules released from the surface for the generation, dispersion and delivery of chemical compounds.

One embodiment uses the DESI process to deliver a fragrance or any other chemical such as a pharmaceutical compound, or any combination of one or more compounds into the human olfactory and/or pulmonary systems.

In several embodiments, without the electrospray voltage, the pharmaceutical and/or fragrance compounds leave the surface containing the chemical molecules at a slow rate which is in part determined by the volatility and normal evaporation rate of the molecule. This rate can be very slow compared to the rate using the electrospray voltage. When the electrospray voltage is active, the charged electrospray droplets and solvent ions impact the surface and release the pharmaceutical or fragrance compounds at a greatly accelerated rate in the form of charged ions. In a normal electrospray configuration without an airflow, many of the released ions would be diverted back onto the surface of the grounded electrode due to the presence of the strong electric field.

An advantage of the present invention is that pharmaceutical and fragrance compounds can be released into the air using an electrospray process even if the compounds are not soluble or have very limited solubility in the electrospray solvent (For example, some fragrance compounds are soluble primarily in oil, but not water). A strong airflow created by the fan sweeps the released compounds out of the electric field region. Thus, the fan speed and corresponding air velocity in the air channel between the array of electrospray sources and the grounded counter electrode is controlled such that the majority of molecules released by the DESI process escape the high field region and move out of the device for subsequent delivery into the human olfactory or pulmonary systems.

With reference to the figures, FIG. 1 is a schematic diagram of aspects of an embodiment according to the inventive subject matter. Solvent such as water is contained in the solvent reservoir 102. In the illustrated embodiment, an array of electrospray sources 104, for example wicks, capillary needles, or one or more of any other suitable electrospray sources, are connected to a liquid reservoir 102 containing a liquid solvent such as water or water mixed with alcohol. The reservoir 102 is held at a high potential with respect to a grounded counter electrode 106. The electrode 106 in this embodiment is constructed of a metal material. Multiple electrospray sources can be used in series or in parallel in order to increase the quantity of fragrance or drug delivered. This may be desirable in some embodiments, for example, to provide a sufficient amount of fragrance for a room or an office-sized region.

Additionally, in this embodiment, the applied potential is large enough (typically several kilovolts) so that the electric field between the electrospray sources 104 and the grounded counter electrode 106 is sufficient to produce a stable electrospray. Also shown in this embodiment is a plurality of charged water droplets 108 within the stable electrospray. The applied potential can be either static (DC) or alternating polarity (AC). In some embodiments an AC electrospray potential may be useful in order to reduce surface charge accumulation as surface charge accumulation becomes a problem when the surface is an electrical insulator.

The surface layer 110 of the grounded counter electrode 106 contains one or more chemical molecules such as a pharmaceutical or fragrance compounds. In use, the pharmaceutical or fragrance compounds can be deposited onto the surface of a grounded, metallic electrode creating a surface layer 110. The compounds may also be incorporated into a host material such as a polymer, a biological matrix such as a tobacco leaf, or any other suitable medium. The electrically conducting grounded counter electrode 106 can consist of a metal plate or any other suitable substrate known to those skilled in the art.

When the electrospray is inactive, such as when the voltage is off, the pharmaceutical or fragrance compounds will leave the surface layer 110 at a slower rate than when the voltage is turned on. This rate is determined by the volatility and normal evaporation rate of the molecule, which can be very slow. Other factors such as the type of medium used as the host material may also affect the rate. In this embodiment, when the electrospray voltage is turned on, the charged electrospray droplets and solvent ions impact the surface layer 110 and release the pharmaceutical or fragrance compounds in the form of charged ions at a greatly accelerated rate as compared to the turned off rate.

Normally, many of the released ions would be diverted back onto the surface layer 110 due to the presence of the strong electric field. However, in the illustrated embodiment, a fan 112 is used to create an air flow pattern moving in parallel to the electrode surface. The air flow created by the fan 112 moves the released compounds out of the electric field region and helps disperse the released fragrance or drug. In one embodiment, the fan 112 is oriented such that the airflow is blown across the surface from which the drug or fragrance is being released.

As the air flow is increased to a faster rate, the compounds will also be swept out of the embodiment at a faster rate. Thus, the fan speed and corresponding air velocity in the air channel between the array of electrospray sources 104 and the grounded counter electrode 106 are controlled such that the majority of molecules 114 released by the DESI process escape the high field region and move out of the device for subsequent delivery into ambient air. Other methods may also be used to maintain the airflow, for example maintaining a low air pressure on one side of the embodiment and a high pressure on another side. Once in the air, the released compounds 114 can be introduced into the human olfactory or pulmonary systems of people in the room or vicinity of the embodiment.

Other embodiments may use any other suitable driving force, for example a vacuum for drawing fragrance ions out of the embodiment's chamber, a second moving air flow pushing the air out of the embodiment, or in other configurations with larger sized molecules or when used with weaker applied fields, gravity could be used to draw out molecules from a vertically positioned chamber.

An advantage of embodiments of the present inventive subject matter is that pharmaceutical and fragrance compounds can be released into the air using an electrospray process even if those compounds are not soluble or have very limited solubility in the electrospray solvent. For example, some fragrance compounds are soluble primarily in oil, but not water.

Another advantage of many embodiments is that the production of molecules such as one or more desirable fragrance compounds can be accomplished with the simultaneous removal of dust, pollen and other particulate air contaminants in the same embodiment using methods and systems of particulate removal as described in U.S. patent application Ser. No. 11/276,355 filed on 24 Feb. 2006 to Gary C. Tepper, which is incorporated by reference in its entirety herein.

In this way, molecules can be released from the surface layer 110 by the impacting electrospray droplets and solvent ions, while particles, due to their much larger mass, will be permanently trapped on the surface and not released by the DESI process. This selective release of fragrance or other compounds and simultaneous capture of particles can be used with multiple applications such as air purifiers, conditioners and cleansers.

In another embodiment, different fragrance, pharmaceutical or any combination of suitable compounds are deposited in a pattern of spots on the grounded counter electrode 106, and one or more specific compounds may be released into the air flow by either rotating the spot containing the desired compound into the electrospray beam or by using a sequence of mechanical shutters to expose the desired spot to the beam. The exposure to the electrospray can also be timed to release one or more specific compounds at one or more times, for one or more preset durations.

In an embodiment used for drug delivery, a user could self medicate by activating the rotation of the surface layer 110 so that the predetermined compound is released. With several rotation positions and spots, a user could change the outputted compound as desired. A pharmaceutical compound could also be used in conjunction with a fragrance compound to act as a signal to the user that the pharmaceutical was successfully being introduced into the body. In one embodiment, a patient could receive a pain reliever when the patient indicated a need for the pain reliving compound using a trigger, such as a switch or button. The spot containing the pain reliever could then be rotated into the electrospray and the compound would be introduced into an air flow in the patient's air flow such as one provided through a nasal cannula. The compound would be then be inhaled into the nasal passages and lungs in a form that would contribute to rapid absorption into the blood stream leading to a rapid rate of pain relief.

Other embodiments can use mechanical shutters or any other suitable mechanism to accomplish the same or similar results. Other embodiments can introduce compounds into a patient using a timing mechanism to ensure that the compounds, such as pharmaceutical compounds, were delivered at predetermined times without the patient's involvement. This can avoid anxiety related with traditional methods of introducing pharmaceuticals into the body such as needles and can also contribute to the consistent adhering of medication delivery schedules, a common problem with many patients who forget to take medications at specific intervals.

Other applications of the systems, methods and apparatuses include the treatment of air in the home and the office, as well as pulmonary drug delivery. In another embodiment, nicotine is released from an organic matrix (tobacco leaf) used as the surface layer 110 and delivered into the users lungs without a combustion process and the associated generation of carcinogenic combustion products. Other embodiments could be used to calculate and deliver specific amounts of compounds such as nicotine. These embodiments could be used to slowly decrease the amount of compounds introduced into a person over time, such as a smoker desiring to quit smoking.

In one embodiment, nicotine can be released from an organic matrix such as a tobacco leaf and be delivered into the lungs without a combustion process and the associated generation of carcinogenic combustion products. Other embodiments include methods for home and office air treatment as well as pulmonary drug delivery. Other embodiments incorporate the cleansing of air particulates such as dust and pollen which at the same time may be introducing chemical compound gaseous ions into the air.

In one embodiment, the surface onto which the electrospray droplets are directed is controlled and contains a specific fragrance compound or drug (e.g. nicotine) in a specific concentration and with certain desirable properties. For example, the fragrance compound may have a pleasant odor and a low vapor pressure so that it is not significantly released from the surface by evaporation.

In an embodiment utilized for drug release, the drug concentration on the surface are controlled so that the amount released into the air by the electrospray droplets corresponds to a desired dose. Many compounds, such as nicotine, can be toxic at high concentrations. With the described embodiments, the released compounds can be used for human exposure/consumption as the release rate can be suitably controlled.

In another embodiment, a system or method can be used to calculate the exposure time of one or more spots containing one or more chemical compounds under the electro spray stream so that at least one discrete amount of a nicotine compound is delivered to the airflow. This discrete amount could be delivered at periodic intervals, such as several times per day. The initial amount as well as the number of deliveries over periods of time could then be reduced without the knowledge of the user. Fragrances could be combined with the nicotine to indicate that the nicotine was being delivered. After being associated as a signal to the nicotine in the user's mind, this fragrance could still be delivered with the reduced amounts of nicotine. This association may help lead the user to believe that nicotine was still being delivered when it is being reduced, thereby contributing to the lessening of anxiety in the use undergoing withdrawal symptoms. The placebo effect of the fragrance compound may also help lead to lessen the withdrawal symptoms. Other embodiments combining the release of fragrance with other suitable compounds and substance are also possible.

Other embodiments include apparatuses which utilize the reduction of the temperature of the surface temperature in order to reduce the rate of evaporation using methods of temperature reduction known to those skilled in the art.

Figure 2:
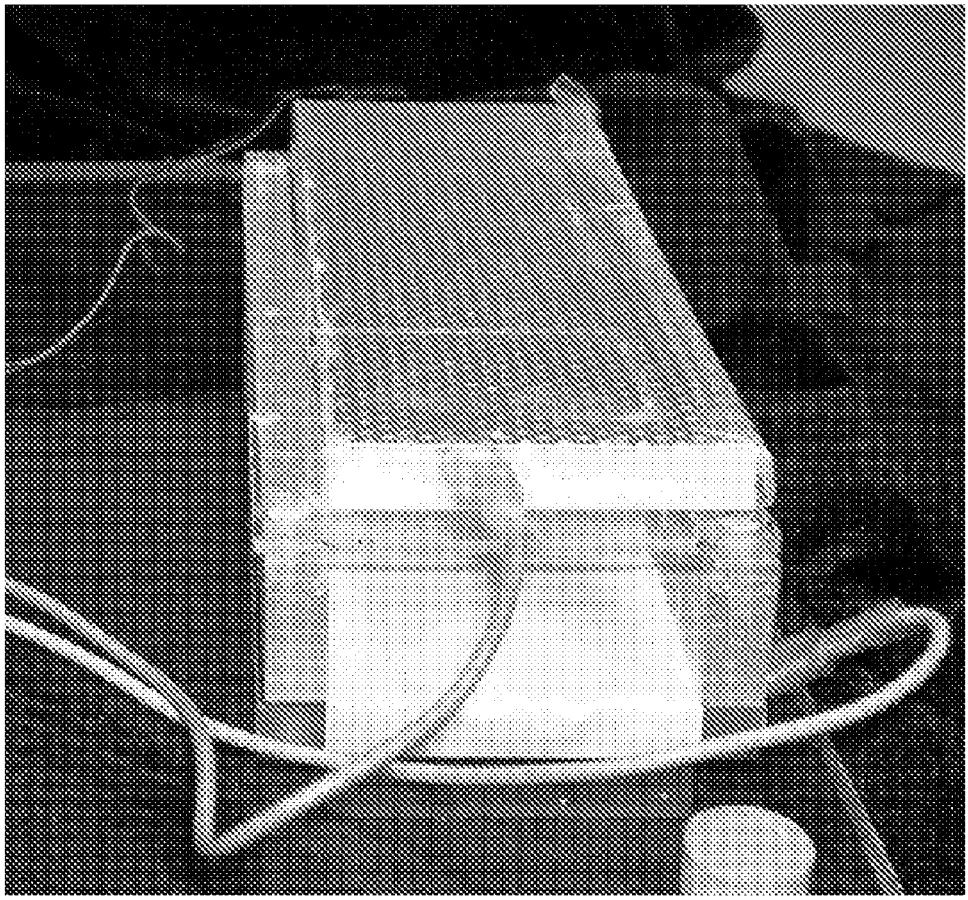
FIG. 2 is an illustration showing aspects of an embodiment.
Figure 3:
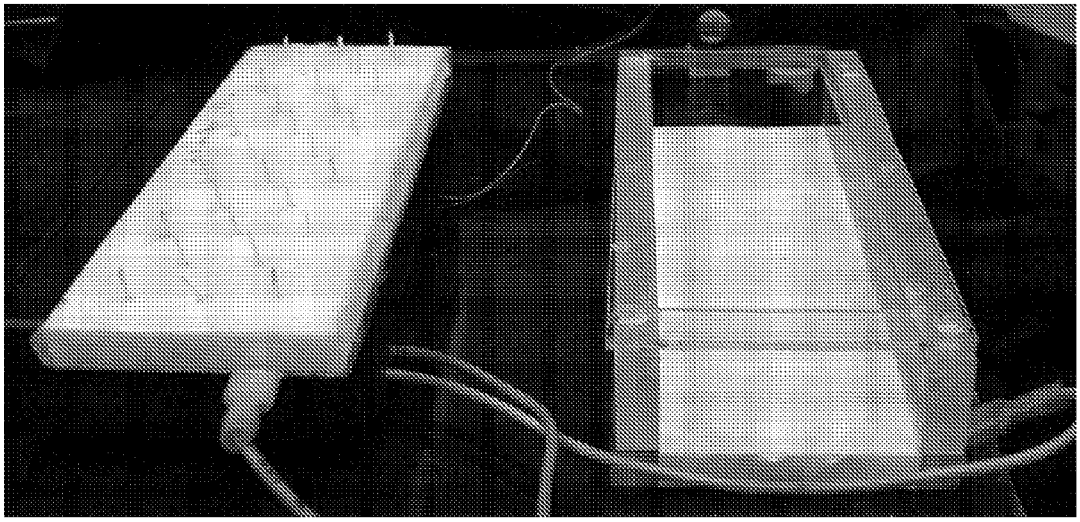
FIG. 3 is another illustration showing aspects of an embodiment of the inventive subject matter.

FIG. 2 is an illustration showing aspects of an embodiment and FIG. 3 is another illustration showing aspects of an embodiment of the inventive subject matter. In these illustrated embodiments, a fabric material containing a fragrance is the medium for the surface layer 110. The fabric material is placed over the grounded electrode and the fragrance is released by the impact of the charged liquid nanodroplets.

Based on the foregoing, it should be appreciated that the various embodiments of the inventive subject matter include other compounds and elements for releasing compounds into the air flow and thus many embodiments can be made without departing from the spirit and scope of the inventive subject matter.

What is claimed is:

1. An apparatus for generating, dispersing and delivering chemical compounds utilizing desorption electrospray ionization comprising:

an airflow channel into which an airflow is directed;

a solvent reservoir containing a volume of solvent;

one or more arrays of electrospray sources in communication with said solvent reservoir for producing a plurality of charged liquid droplets in said airflow channel;

one or more grounded counter electrodes positioned within said airflow channel, said electrodes having at least one surface containing one or more chemical compounds with releasable ions;

wherein the voltage between said one or more grounded counter electrodes and said charged droplet source is sufficient to maintain an electric field sufficient to sustain an electrospray process in said airflow channel;

wherein said charged droplets are directed onto said surface so that the impact of the charged particles on said surface produces gaseous ions from said surface; and wherein said gaseous ions are dispersed into the airflow and directed out of said electric field region.

2. The apparatus for generating, dispersing and delivering chemical compounds utilizing desorption electrospray ionization of claim 1 wherein said airflow is further directed into one or more of the following group: the ambient air, a human olfactory system, a human's pulmonary system, an animal's olfactory system, an animal's pulmonary system.

3. The apparatus for generating, dispersing and delivering chemical compounds utilizing desorption electrospray ionization of claim 1 further comprising a fan to maintain said airflow.

4. The apparatus for generating, dispersing and delivering chemical compounds utilizing desorption electrospray ionization of claim 1 wherein said one or more arrays of electrospray sources is comprised of a plurality of wicks or capillary needles.

5. The apparatus for generating, dispersing and delivering chemical compounds utilizing desorption electrospray ionization of claim 1 wherein said solvent is made up of a compound selected from the following group: water and water mixed with alcohol.

6. The apparatus for generating, dispersing and delivering chemical compounds utilizing desorption electrospray ionization of claim 1 wherein said solvent reservoir is a reservoir pad.

7. The apparatus for generating, dispersing and delivering chemical compounds utilizing desorption electrospray ionization of claim 1 wherein said applied potential is either static (DC) or alternating polarity (AC).

8. The apparatus for generating, dispersing and delivering chemical compounds utilizing desorption electrospray ionization of claim 1 wherein said surface of said grounded counter electrode contains one or more molecules selected from the following group: pharmaceutical molecules, irritant molecules, fragrance molecules, and biological molecules.

9. The apparatus for generating, dispersing and delivering chemical compounds utilizing desorption electrospray ionization of claim 8 wherein said one or more molecules are deposited onto the surface of a grounded electrode.

10. The apparatus for generating, dispersing and delivering chemical compounds utilizing desorption electrospray ionization of claim 8 wherein said one or more molecules are incorporated into a host material which is deposited on or incorporated into the surface of said grounded electrode, said host material being selected from one or more of the following group: a polymer and a biological matrix.

11. The apparatus for generating, dispersing and delivering chemical compounds utilizing desorption electrospray ionization of claim 8 wherein said host material is a tobacco leaf.

12. The apparatus for generating, dispersing and delivering chemical compounds utilizing desorption electrospray ionization of claim 1 further comprising a pressure differential to maintain said airflow.

13. The apparatus for generating, dispersing and delivering chemical compounds utilizing desorption electrospray ionization of claim 1 wherein particles with a larger mass include dust, pollen and other particulate air contaminants are removed from said airflow.

14. The apparatus for generating, dispersing and delivering chemical compounds utilizing desorption electrospray ionization of claim 13 wherein said larger particles are trapped on said surface and not released.

15. The apparatus for generating, dispersing and delivering chemical compounds utilizing desorption electrospray ionization of claim 1 wherein said one or more molecules are deposited or incorporated into a pattern of spots on said surface of grounded counter electrode wherein said surface is moveable and wherein said surface is positionable so that one or more spots containing one or more compound are moved into said electrospray target area so that the compounds may be selected to release gaseous ions and one or more other compounds on said surface are selected to not release gaseous ions.

16. The apparatus for generating, dispersing and delivering chemical compounds utilizing desorption electrospray ionization of claim 1 wherein said one or more molecules are deposited or incorporated into a pattern of spots on said surface of grounded counter electrode wherein said surface is coverable with a positionable cover so that one or more spots containing one or more compound are covered or uncovered in said electrospray target area so that the compounds may be selected to release gaseous ions and one or more other compounds on said surface are selected to not release gaseous ions.

17. The apparatus for generating, dispersing and delivering chemical compounds utilizing desorption electrospray ionization of claim 16 wherein said positionable cover which allows one or more spots to be selectively exposed to said electrospray.

18. The apparatus for generating, dispersing and delivering chemical compounds utilizing desorption electrospray ionization of claim 1 wherein said surface is constructed in part or in whole of a material into which a chemical compound may be added.

19. The apparatus for generating, dispersing and delivering chemical compounds utilizing desorption electrospray ionization of claim 1 wherein said surface is constructed of a material selected from the following group: a fabric, a sponge, and a wax.

20. The apparatus for generating, dispersing and delivering chemical compounds utilizing desorption electrospray ionization of claim 1 wherein the temperature of said surface is adjustable so that the amount of thermal evaporation may be further controlled.

21. The apparatus for generating, dispersing and delivering chemical compounds utilizing desorption electrospray ionization of claim 20 wherein the surface temperature is reduced in order to reduce the rate of evaporation.

22. The apparatus for generating, dispersing and delivering chemical compounds utilizing desorption electrospray ionization of claim 1 wherein the chemical compound is dispersed in a fixed concentration into said airflow.

23. The apparatus for generating, dispersing and delivering chemical compounds utilizing desorption electrospray ionization of claim 1 wherein the chemical compound is dispersed in a range of specific concentrations into said airflow.

24. The apparatus for generating, dispersing and delivering chemical compounds utilizing desorption electrospray ionization of claim 23 wherein the chemical compound is dispersed at a release rate corresponding to a specific dose of a chemical compound.

25. A method for generating, dispersing and delivering chemical compounds utilizing desorption electrospray ionization comprising the steps of:

maintaining an airflow; and dispersing gaseous ions into the airflow using an apparatus comprised of:

an airflow channel into which said airflow is directed;

a solvent reservoir containing a volume of solvent;

one or more arrays of electrospray sources in communication with said solvent reservoir for producing a plurality of charged liquid droplets in said airflow channel;

one or more grounded counter electrodes positioned within said airflow channel, said electrodes having at least one surface containing one or more chemical compounds with releasable ions;

wherein the voltage between said one or more grounded counter electrodes and said charged droplet source is sufficient to maintain an electric field sufficient to sustain an electrospray process in said airflow channel;

wherein said charged droplets are directed onto said surface so that the impact of the charged particles on said surface produces gaseous ions from said surface into said airflow.

* * * * *